United States Patent [19]

Inada et al.

[11] Patent Number: 4,805,689

[45] Date of Patent: Feb. 21, 1989

[54] OUTDOOR UNIT FOR A HEAT PUMP

[75] Inventors: Masami Inada, Kariya; Shigenori Haramura, Toyoake; Seiji Hayakawa, Nagoya; Sadayuki Matsuoka, Ohbu, all of Japan

[73] Assignee: Aisin Seiki Kabushiki Kaisha, Kariya, Japan

[21] Appl. No.: 54,693

[22] Filed: May 27, 1987

[30] Foreign Application Priority Data

May 29, 1986 [JP] Japan ..... 61-081652[U]

[51] Int. Cl.[4] ..... F25B 29/00; G05D 23/00

[52] U.S. Cl. ..... 165/29; 62/238.6; 62/238.7; 237/2 B

[58] Field of Search ..... 165/29; 62/238.6, 238.7; 237/2 B

[56] References Cited

U.S. PATENT DOCUMENTS

| | | | |
|---|---|---|---|
| 4,112,705 | 9/1978 | Sisk et al. | 165/29 |
| 4,178,772 | 12/1979 | Swenson et al. | 62/238.6 |
| 4,179,901 | 12/1979 | Fiala et al. | 62/238.6 |
| 4,187,687 | 2/1980 | Savage | 237/2 B |
| 4,190,199 | 2/1980 | Cawley et al. | 62/235.1 |
| 4,256,475 | 3/1981 | Schafer | 62/238.7 |
| 4,346,755 | 8/1982 | Alley et al. | 165/29 |
| 4,408,715 | 10/1983 | Gueneau | 62/323.1 |
| 4,553,401 | 11/1985 | Fisher | 237/2 B |
| 4,569,207 | 2/1986 | James | 62/238.6 |
| 4,614,090 | 9/1986 | Kaneko et al. | 62/238.6 |

FOREIGN PATENT DOCUMENTS

| | | | |
|---|---|---|---|
| 1187301 | 5/1985 | Canada | 165/29 |
| 2804895 | 8/1979 | Fed. Rep. of Germany | 62/238.6 |
| 3002387 | 8/1981 | Fed. Rep. of Germany | 62/238.6 |
| 3407453 | 9/1985 | Fed. Rep. of Germany | 237/2 B |
| 2547027 | 12/1984 | France | 62/238.6 |
| 161435 | 10/1982 | Japan . | |
| 164241 | 10/1982 | Japan . | |
| 161457 | 10/1982 | Japan . | |
| 0164240 | 10/1982 | Japan | 62/238.7 |
| 134173 | 7/1985 | Japan . | |
| 116161 | 8/1985 | Japan . | |
| 2059563 | 4/1981 | United Kingdom | 62/238.6 |
| 2064755 | 6/1981 | United Kingdom | 237/2 B |

*Primary Examiner*—Albert W. Davis, Jr.
*Assistant Examiner*—John K. Ford
*Attorney, Agent, or Firm*—Sughrue, Mion, Zinn, Macpeak, and Seas

[57] ABSTRACT

An outdoor unit for a heat pump is usable under very cold weather conditions since the outdoor unit includes an auxiliary heating system which heats a heat exchanger in order to prevent the heat exchanger from forming frost and which also compensates for the decline in heating capacity. Further, the outdoor unit has an air flow preventing arrangement which prevents the flow of air through the heat exchanger when the absorption of the heat from the atmosphere is not efficient. The outdoor unit drives compressors by an internal combustion engine in order to reduce the consumption of electric power and the coolant for the engine is also utilized to provide auxiliary heat to the heat exchanger. The outdoor unit also includes a boiler to compensate for the lack of heating capacity in the engine waste heat. The boiler is operated when the atmospheric temperature is less than the predetermined value.

6 Claims, 2 Drawing Sheets

OUTDOOR UNIT FOR A HEAT PUMP

BACKGROUND OF THE INVENTION

This invention relates to an outdoor unit for a heat pump and more particularly relates to an improved outdoor unit that has sufficient heating capacity under very cold weather conditions.

A heat pump is capable of heating more efficiently than other heating systems. However the heating capacity of a heat pump depends on the temperature surrounding the outdoor unit because the heat pump uses heat that is pumped from the atmosphere surrounding the outdoor unit. Therefore, in a heat pump, the heating capacity and heating efficiency deteriorates according to the decrease in atmospheric temperature. To compensate for this deterioration, Japanese Utility Model Laid Open Print 116161/1985 has suggested the utilization of waste heat from an internal combustion engine by leading the coolant of the engine to the heat exchanger of the outdoor unit.

However the deterioration of the heating capacity and heating efficiency can not be compensated sufficiently under very cold weather conditions because the heat exchanger of the outdoor unit performs as a heat radiator and radiates the waste heat from the heat exchanger to the atmosphere surrounding the outdoor unit.

SUMMARY OF THE INVENTION

Accordingly, one of the objects of this invention is to provide an improved outdoor unit of a heat pump which obviates the above drawbacks.

It is also an object of this invention to provide an improved outdoor unit which has sufficient heating capacity under very cold weather conditions.

It is is a further object of this invention to provide an efficient outdoor unit which has a variable heating capacity for compensation against the atmospheric temperature surrounding the outdoor unit.

Further, it is an object of this invention to provide an economical outdoor unit which reduces the consumption of fuel.

Furthermore it is an object of this invention to provide an efficient outdoor unit which utilizes the waste heat of an internal combustion engine.

A still further object of this invention is to provide an efficient outdoor unit which heats the heat exchanger indirectly.

Still another object of this invention is to provide an outdoor unit which reduces the consumption of electric power.

Another object of this invention is to provide an efficient outdoor unit which avoids radiation of heat from the heat exchanger to the atmosphere.

Still another object of this invention is to provide an efficient outdoor unit which prevents a thermal connection between the heat exchanger and the atmosphere.

Yet another object of this invention is to provide a sensitive outdoor unit against the atmospheric temperature which surrounds the outdoor unit.

To achieve the above objects of the invention the outdoor unit comprises:

auxiliary heating means to heat a heat exchanger;

flow preventing means to prevent air flow through said heat exchanger;

temperature sensing means to sense very cold weather conditions; and controlling means to control said auxiliary heating means and said flow preventing means according to said temperature sensing means.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
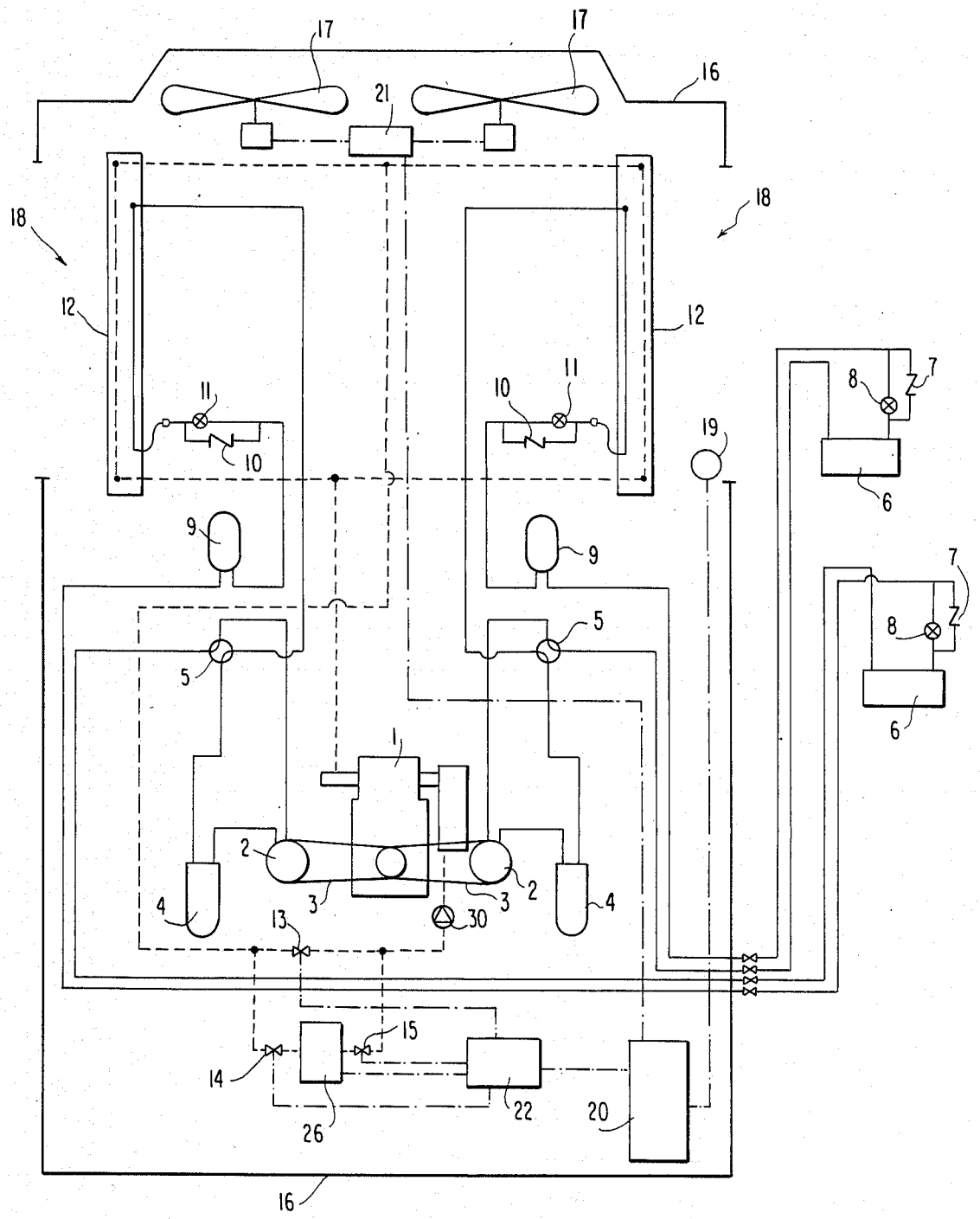
FIG. 1 is a schematic diagram showing a first embodiment of the present invention.

Referring now to FIG. 1, an internal combustion engine 1 consumes LNG (Liquid Natural Gas) or LPG (Liquid Propane Gas) as a fuel. The internal combustion engine 1 drives two compressors simultaneously in two independent circuits (shown by a solid line in FIG. 1) each of which contains a working medium. Since the two circuits containing the working media are identical only one circuit will be described in detail.

The internal combustion engine 1 and the compressor 2 are connected with each other by a rubber belt 3. The compressor 2 compresses the working medium led from outdoor heat exchanger 12 through the accumulator 4 and sends the working medium to a selecting valve 5. The selecting valve 5 selects the air cooling mode or air heating mode by changing the directional flow of the work medium. FIG. 1 shows the air heating mode. As the air cooling mode is not pertinent to the present invention, an explanation of the air cooling mode will be omitted.

The work medium is sent from compressor 2 through selecting valve 5 to an indoor heat exchanger 6. The work medium, which is compressed by the compressor 2, radiates a heat of condensation at the indoor heat exchanger 6 and heats the atmosphere of the room where the indoor heat exchanger 6 is located.

Next, the working medium is sent from the indoor heat exchanger 6 through a one way valve 7 to a receiver 9. The receiver 9 is a container which absorbs and regulates changes of the liquid measure of the working medium. The working medium, which is stored in the receiver 9, is sent to an outdoor heat exchanger 12 through an expansion valve 11. The working medium absorbs the heat from the outdoor heat exchanger 12 and then evaporates in the outdoor heat exchanger 12. The work medium evaporated in the outdoor heat exchanger 12 is sent to the accumulator 4.

Thus the working medium circulates in the above described circuit for the working medium when the heat pump operates in the air heating mode.

The internal combustion engine 1 also performs as a first auxiliary heating means which heats the outdoor heat exchanger 12. Accordingly, the coolant of the internal combustion engine 1 is sent from the engine 1 to the outdoor heat exchanger 12 by a circulation pump 30. The coolant of the engine 1 circulates in the circuit which is shown by a dotted line. The coolant of the engine 1 is cooled by giving the heat to the working medium flowing through the outdoor heat exchanger 12. Then the coolant cooled by the outdoor heat exchanger 12 returns to the engine 1 through an ON/OFF valve 13 and the circulation pump 30.

The ON/OFF valve 13 has two ports. As shown in FIG. 1, ON/OFF valves 14 and 15, and a boiler 26 are connected serially between both ports of the valve 13. The boiler 26 heats the coolant of the internal combustion engine 1 and therefore acts as a second auxiliary heating means. The boiler 26 of this embodiment also consumes LNG or LPG as a fuel.

Thus, the coolant of the engine 1 circulates in the above circuit when the heat pump operates in the air heating mode.

Two fans 17 are fixed to a housing 16 of the outdoor unit and exhaust the air in the housing 16 in order to create air flow through the outdoor heat exchangers 12. Further a temperature sensor 19 is fixed in at least one of the air intakes 18 extending through the housing 16 and detects the atmospheric temperature surrounding the outdoor unit. The temperature sensor 19 is electrically connected to an electric controlling circuit 20. A fan driving circuit 21 and a boiler driving circuit 22 are connected to the electric controlling circuit 20. The electrical connection is shown by the broken lines in FIG. 1. The electric controlling circuit 20 controls the fan driving circuit 21 and the boiler driving circuit 22 according to the signal of the temperature sensor 19 and therefore performs as the controlling means.

The outdoor unit constructed above operates as follows:

When the atmospheric temperature surrounding the outdoor unit is above a predetermined value, the electric controlling circuit 20 detects this condition by the temperature sensor 19 and orders the fan driving circuit 21 to rotate the fans 17 and also orders the boiler driving circuit 22 not to heat the coolant of the engine 1. At this time the fan driving circuit 21 supplies electric power to the fans 17 and the boiler driving circuit 22 sets the ON/OFF valves 14 and 15 in the closed state and also sets the ON/OFF valve 13 in the communicating state in order to circulate the coolant of the engine 1 without passing through the boiler 26. Thus, although the coolant of the engine 1 flows through the outdoor heat exchanger 12, the working medium mainly absorbs the heat from the atmosphere flowing through the outdoor heat exchangers 12 and then heats the room.

The heat absorption by the working medium from the atmosphere in the outdoor heat exchangers 12 mainly depends on the difference between the evaporating temperature of the working medium and atmospheric temperature of the air flowing through heat exchangers 12. The evaporating temperature of the working medium mainly depends on the capacity of the compressors 2, the capacity of the heat exchangers 12 and the atmospheric temperature surrounding the outdoor unit. The difference between the setting temperature of the heat pump and the actual temperature of the room also affects the working medium temperature as a result of system controls. Once the design conditions of the heat pump, such as the surface area of heat exchanger 12, maximum capacity of compressors 2, quantity of working medium, etc., are determined (for example, atmospheric temperature of 45° F.), then the design condition can not be changed even if much more capacity is required during lower temperatures than the design condition. Therefore, if the atmospheric temperature surrounding the outdoor unit becomes lower than usual, the difference of the temperature between the working medium in the outdoor heat exchangers 12 and surrounding atmosphere becomes small. Thus, heat absorption from the surrounding atmosphere becomes less.

When the atmospheric temperature surrounding the outdoor unit is less than the predetermined value, the electric controlling circuit 20 detects this condition by the temperature sensor 19, and orders the fan driving circuit 21 to stop rotating the fans 17 and also orders the boiler driving circuit 22 to heat the coolant of the engine 1. At this time the fan driving circuit 21 stops supplying the electric power to the fans 17 and the boiler driving circuit 22 sets the ON/OFF valves 14 and 15 in the open or communicating states and also sets the ON/OFF valve 13 in the closed state in order to circulate the coolant of the engine 1 through the boiler 26. Then the working medium does not absorb the heat from the atmosphere flowing through the outdoor heat exchangers 12 but mainly absorbs heat from the coolant flowing through the outdoor heat exchangers 12 because the air flow through the outdoor heat exchangers 12 has closed due to stopping the rotation of the fans 17.

The temperature of the coolant which has passed through the outdoor heat exchangers 12 is lowered by a comparatively large amount because the coolant is cooled by the working medium. The cooled coolant is sent from the outdoor heat exchangers 12 to the boiler 26 through the ON/OFF valve 14. The boiler 26 heats the cooled coolant and sends the heated coolant to the engine 1.

If the boiler 26 is not provided and the cooled coolant from the outdoor heat exchangers 12 is directly flow into the engine 1, the engine 1 may be over cooled and the lifetime of the engine 1 may be shortened. However, according to this invention, the engine 1 should never be over cooled because the boiler 26 heats the cooled coolant before the coolant flows into the engine 1 when the atmospheric temperature is below a predetermined value. Furthermore, the outdoor heat exchangers 12 should not form frost when the fans 17 stop rotating in order to prevent the heat from radiating to the air flowing through the outdoor heat exchangers 12.

Figure 2:
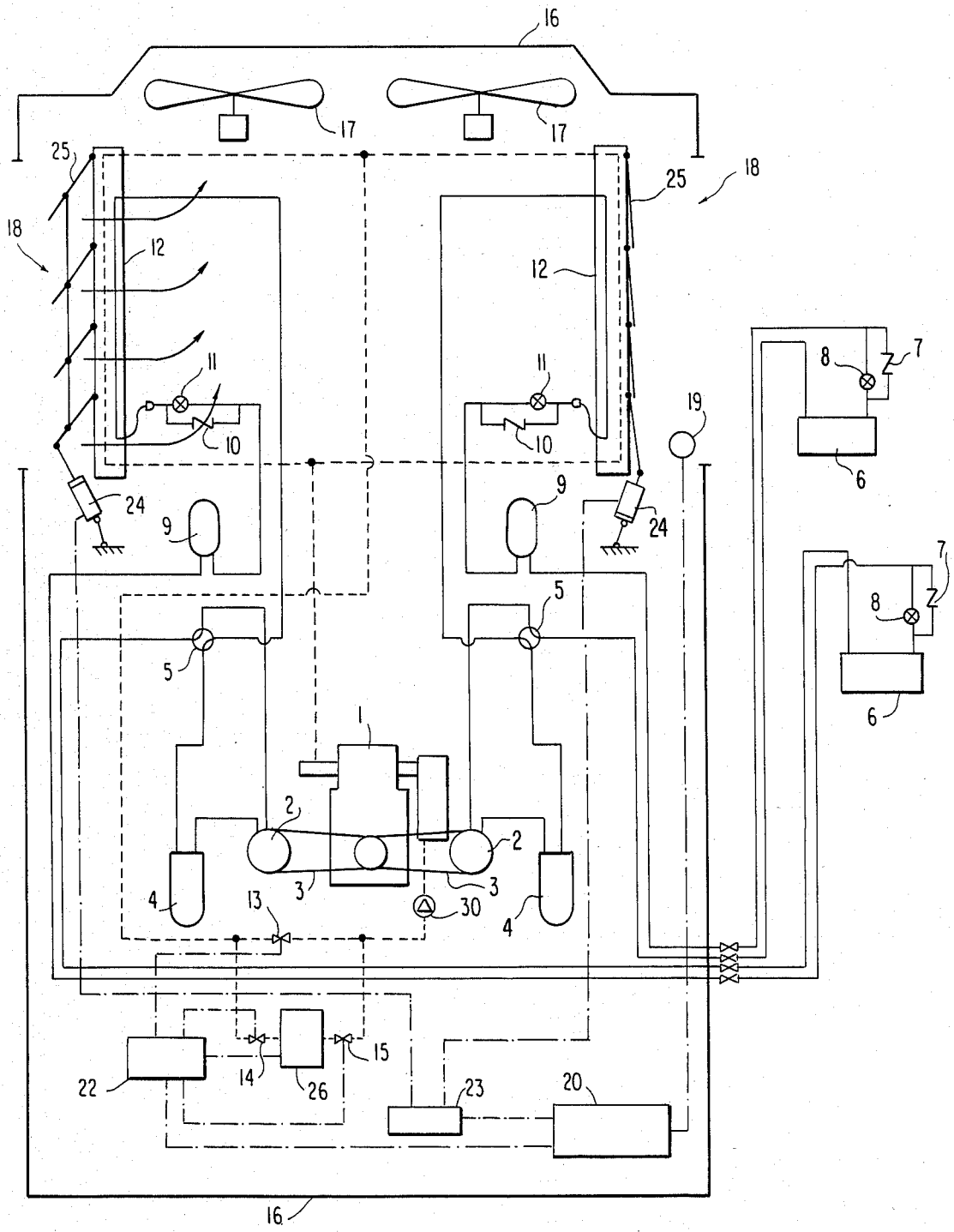
FIG. 2 is a schematic diagram similar to FIG. 1 showing a second embodiment of the invention.

Referring to FIG. 2, the second embodiment of the invention will be explained. A detailed explanation of the circuit of the coolant and circuit of the working medium will be omitted since both of the circuits are the same as shown in FIG. 1. As in FIG. 1 the circuit of the working medium is shown by solid lines and the circuit of the coolant is shown by dotted lines and the electrical connections are shown by broken lines. Once again, both circuits for the working medium are identical.

In the second embodiment both the internal combustion engine 1 and the boiler 26 consume LNG or LPG as a fuel.

A shutter 25 which covers one surface of an air intake 18 is fixed to the outdoor heat exchanger 12 in order to prevent air flow through the outdoor heat exchanger 12. An actuator 24 is fixed to the housing 16 in order to open or close the shutter 25. Further, the temperature sensor 19 is fixed adjacent a air intake 18 which extends through the housing 16. The temperature sensor 19 is electrically connected to the electric controlling circuit 20. A shutter driving circuit 23 and the boiler driving circuit 22 are also connected to the electric controlling circuit 20. The electric controlling circuit 20 controls both the shutter driving circuit 23 and the boiler driving circuit 22 according to the signal from the sensor 19.

The outdoor unit constructed above operates as follows:

In the second embodiment of the invention the fans 17, which are located in the housing 16, rotate as soon as the engine 1 is started. When the atmospheric temperature surrounding the outdoor unit is above a predetermined value, the electric controlling circuit 20 detects this condition by temperature sensor 19. Then the electric controlling circuit 20 orders the shutter driving circuit 23 to open the shutter 25 and also orders the boiler driving circuit 22 not to heat the coolant of the engine 1. At this time, the shutter driving circuit 23 opens the shutters 25 by driving the actuator 24. The boiler driving circuit 22 sets the ON/OFF valve 14 to the closed state in order to circulate the coolant of the engine 1 without passing through the boiler 26. The working medium in the outdoor heat exchangers 12 mainly absorbs the heat from the atmosphere surrounding the outdoor unit and heats the room where the indoor heat exchangers 6 are located.

When the atmospheric temperature surrounding the outdoor unit is less than the predetermined value, the electric controlling circuit 20 detects this condition by the temperature sensor 19 and orders the shutter driving circuit 23 to close the shutters 25 and also orders the boiler driving circuit 22 to heat the coolant of the engine 1. At this time the shutter driving circuit 23 actuates the actuators 24 in order to close the shutters 25. Further, the boiler driving means 22 sets the ON/OFF valves 14 and 15 to the open or communicating state in order to connect the boiler 26 into the circuit of the coolant and sets the ON/OFF valve 13 to the closed state in order to circulate the coolant through the boiler 26. Thus, the air flow through the outdoor heat exchangers 12 stops and the working medium mainly absorbs the heat from the coolant of the engine 1.

In the second embodiment the engine 1 will not be over cooled because the boiler 26 heats the coolant before the coolant flows into the engine 1. Furthermore, in the second embodiment the outdoor heat exchangers 12 are independent or isolated from the atmosphere surrounding the outdoor unit when the shutters 25 are closed. Therefore the outdoor heat exchangers 12 should not form frost on the surface thereof.

In the second embodiment the fans 17 are still rotating when the shutters 25 are closed. However the fans 17 do not have to rotate when the shutters 25 are closed. Therefore the fans 17 can be stopped as soon as the shutters 25 are closed.

In the first and second embodiments the electric controlling circuit 20 detects very cold weather conditions by the sensor 19 which detects the atmospheric temperature surrounding the outdoor unit. However the electric controlling circuit 20 can detect a very cold weather condition by detecting the temperature of the working medium through the outdoor heat exchanger 12 or by calculating the difference between the set temperature of the heat pump and the actual atmospheric temperature in the room.

In the first and second embodiments the compressors 2 are driven by an internal combustion engine 1. However the compressors can be driven by an electric motor. If the compressors 2 are driven by an electric motor, the boiler 26 should have an increased heating capacity since the boiler 26 must not only heat the outdoor heat exchanger 12 in order to prevent frost from forming during the air heating mode but must also provide a comparatively large amount of heat in order to compensate for the deterioration of the heating capacity under very cold weather conditions.

While the invention has been particularly shown and described with reference to preferred embodiments thereof it will be understood by those in the art that the foregoing and other changes in form and details may be made therein without departing from the spirit and scope of the invention.

What is claimed is:

1. An outdoor unit for an internal combustion engine driven heat pump comprising:

a heat exchanger in said outdoor unit forming a portion of said heat pump;

fan means for circulating air through said heat exchanger;

auxiliary heating means including a boiler and said internal combustion engine for heating a liquid medium and circulation means for circulating said liquid medium through said heat exchanger, said boiler and said engine, said liquid medium acting as a coolant for said engine;

air flow preventing means for preventing air flow through said heat exchanger;

temperature sensing means for sensing very cold weather conditions; and controlling means connected to and controlling said boiler and said flow preventing means according to said temperature sensing means.

2. An outdoor unit according to claim 1 wherein said auxiliary heating means have means for burning LNG as a fuel.

3. An outdoor unit according to claim 1 wherein said air flow preventing means is a fan means driving circuit connected to said controlling means and said fan means for controlling the operation of said fan means.

4. An outdoor unit according to claim 1 wherein said flow preventing means is comprised of shutter means on said outdoor unit and a shutter means driving circuit including means for moving said shutter means connected to said controlling means for controlling the opening and closing of said shutter means.

5. An outdoor unit according to claim 1 wherein said temperature sensing means is fixed in an air intake of said heat exchanger.

6. An outdoor unit according to claim 1 wherein said controlling means activates said flow preventing means and said boiler when said temperature sensing means detects a temperature lower than a predetermined temperature.

* * * * *